US006672529B2

(12) United States Patent
Cain et al.

(10) Patent No.: US 6,672,529 B2
(45) **Date of Patent: *Jan. 6, 2004**

(54) REEL SPOOL AND STAND ASSEMBLY FOR COILED TUBING INJECTOR SYSTEM

(75) Inventors: Troy D. Cain, Burleson, TX (US); John E. Goode, Arlington, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/248,247

(22) Filed: Dec. 30, 2002

(65) Prior Publication Data

US 2003/0071160 A1 Apr. 17, 2003

Related U.S. Application Data

(63) Continuation of application No. 09/711,733, filed on Nov. 13, 2000, now Pat. No. 6,527,215.
(60) Provisional application No. 60/165,248, filed on Nov. 12, 1999.

(51) Int. Cl.[7] ..... B65H 75/30
(52) U.S. Cl. ..... 242/394; 242/596; 242/613
(58) Field of Search ..... 242/394, 394.1, 242/397, 397.1, 398, 390, 596, 598, 609, 611, 611.1, 612, 613

(56) References Cited

U.S. PATENT DOCUMENTS

| | | | | | |
|---|---|---|---|---|---|
| 2,008,612 | A | * | 7/1935 | Heath | 242/394.1 |
| 3,346,213 | A | * | 10/1967 | Nelson | 242/390 |
| 3,394,897 | A | * | 7/1968 | Martin, Sr. | 242/598 |
| 3,650,492 | A | * | 3/1972 | Stum | 242/390 |
| 3,952,961 | A | * | 4/1976 | Antepenko | 242/598 |
| 5,836,536 | A | * | 11/1998 | Bodden | 242/394 |
| 6,182,716 | B1 | * | 2/2001 | Fry | 242/390 |
| 6,527,215 | B1 | * | 3/2003 | Cain et al. | 242/394 |

* cited by examiner

*Primary Examiner*—William A. Rivera
(74) *Attorney, Agent, or Firm*—Marc A. Hubbard; Munsch Hardt Kopf & Harr, P.C.

(57) ABSTRACT

A spool for carrying continuous pipe or coiled tubing for a coiled tubing injector is dropped into a stand at a site and coupled to a rotary power source. The stand includes two axles, on either side of the spool, and a drive plate. The spool includes on each side a supporting hub with slot that allows the axle to slide into the hub and the slot to be closed. At the same time, a coupling member on the drive plate slides into a mating contact with a complementary coupling member on the spool. Thus, the spool is mounted and coupled to a rotary power source with comparative ease and quickness, facilitating use of multiple spools for both transportation and operation at the well site.

3 Claims, 17 Drawing Sheets

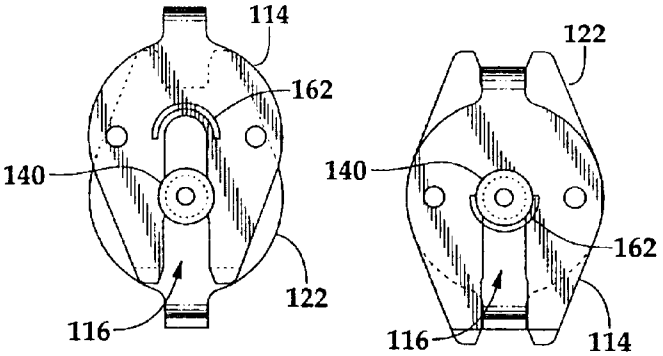
Fig.21A
Fig.21B
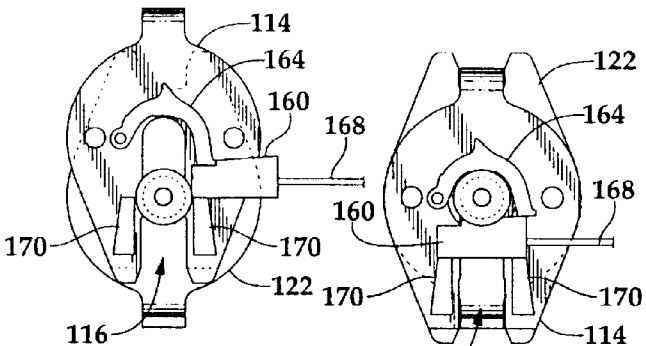
Fig.22A
Fig.22B
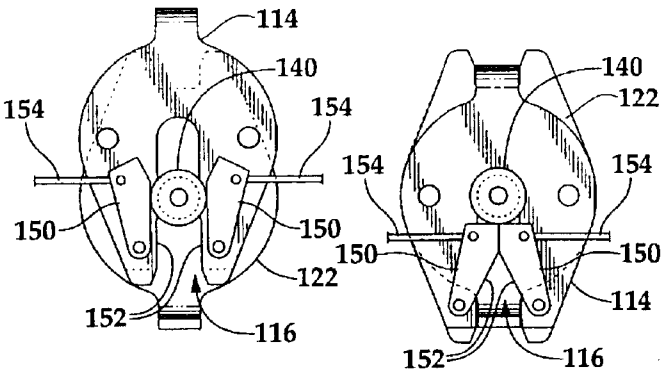
Fig.19A
Fig.19B
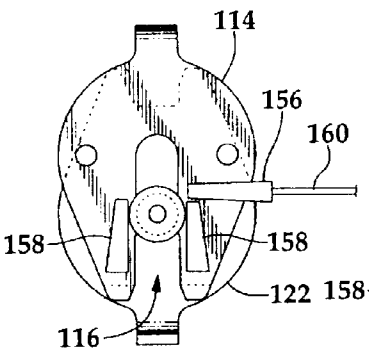
Fig.20A
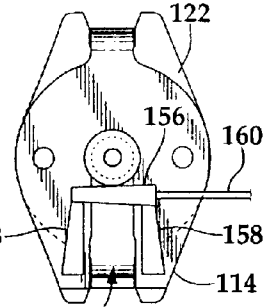
Fig.20B

REEL SPOOL AND STAND ASSEMBLY FOR COILED TUBING INJECTOR SYSTEM

CROSS REFERENCE TO RELATED APPLICATIONS

This application is a continuation and claims priority to U.S. patent application Ser. No. 09/711,733 filed Nov. 13, 2000, now U.S. Pat. No. 6,527,215, which claims priority to U.S. Provisional Application No. 60/165,248 filed on Nov. 12, 1999, now expired.

BACKGROUND OF INVENTION

The invention pertains generally to coiled tubing reels used in conjunction with coiled tubing injectors for performing well servicing and coiled tubing drilling operations.

Continuous pipe, generally known within the industry as coiled tubing since it is stored on a large reel, has been used for many years. It is much faster to run into and out of a well bore than conventional jointed straight pipe since there is no need to join or disconnect short segments of straight pipe.

Coiled tubing "injectors" are machines that are used to run continuous strings of pipe into and out of well bores. The injector is normally mounted to an elevated platform above a wellhead or is mounted directly on top of a wellhead. A typical coiled tubing injector has two continuous chains. The chains are mounted on sprockets to form two elongated loops that counter rotate. The chains are placed next to each other in an opposing fashion. Tubing is fed between the chains. Grippers carried by each chain come together on opposite sides of the pipe and are pressed against it. The injector thereby continuously grips a length of the tubing as it is being moved in and out of the well bore. Examples of coiled tubing injectors include those shown and described in U.S. Pat. No. 5,309,900, and U.S. applications Ser. Nos. 09/070,592 and 09/070,593, all of which are incorporated herein by reference.

A coiled tubing reel assembly includes a stand for supporting a spool on which tubing is stored, a drive system for rotating the reel and creating back-tension during operation of the reel, and a "level winding" system that guides the tubing as it is being unwound from and wound onto the spool. The level winding system moves the tubing laterally across the reel so that the tubing is laid across the reel in a neat and organized fashion. The coiled tubing reel assembly must rotate the spool to feed tubing to and from the injector and well bore. The tubing reel assembly must also tension the tubing by always pulling against the injector during normal operation. The injector must pull against the tension to take the tubing from the tubing reel, and the reel must have sufficient pulling force and speed to keep up with the injector and maintain tension on the tubing as the tubing is being pulled out of the well bore by the injector. The tension on the tubing must always be maintained. The tension must also be sufficient to wind properly the tubing on the spool and to keep the tubing wound on the spool. Consequently, a coiled tubing reel assembly is subject to substantial forces and loads.

A guidance arch extends from the top of the injector to provide a supported arched path to direct the coiled tubing leaving the tubing reel into the top of the injector.

Alternately, as shown in U.S. Pat. No. 5,660,235, the reel can be positioned on top of the injector so that tubing is fed in a straight line into the top of the injector.

Historically, tubing reel assemblies have been shipped to wells with the required coiled tubing wound on the spool, and the spool installed in the reel assembly. Such spools are specially designed for the particular reel assembly and not meant to be disconnected or removed from the reel assembly during normal operation. A second reel assembly would therefore also have to be sent if there was need for different diameter tubing or in the event that replacement tubing was required. Alternately, if replacement tubing was required, a shipping spool could be used to transport replacement tubing to the well. A lightweight spooling stand would then have to be used to support the shipping spool to transfer the tubing onto the spool of the working reel assembly. To save weight and size, these shipping spools did not possess the structure necessary to handle the loads typically imposed on reels during coiled tubing operations. Rather, shipping spools were designed as a relatively inexpensive means of transporting the tubing from a factory to a well. Therefore, transferring tubing from the shipping spool to the working reel assembly was necessary.

Transferring tubing from a shipping spool to a working reel induces extra strain in the tubing as it is unwound from the shipping spool then rewound onto the working spool. Since metal tubing is plastically deformed during spooling, transferring coiled tubing from a shipping spool to a working reel assembly reduces the life or number of hours that the tubing can be used, thus increasing the cost of coiled tubing operations. Furthermore, transfers typically involve spooling 20,000 to 25,000 feet of tubing at rates of 100 to 200 feet per minute. Therefore, considerable time is required to complete a transfer.

There exist coiled tubing reel stands for receiving common and ordinary shipping spools for use as working reels. These tubing reel assemblies require inserting a shaft through the center of the spool, and inserting a pair of driving knobs, mounted to a drive plate on the stand, into the side of the spool to provide the connection for the drive system. As a consequence, this type of reel stand has several problems. First, the reel stand either has to be separable into two halves so that the sides of the stand can be moved laterally away from each other, or has to have the sides of the stand capable of being swung outwardly, in order to allow the shipping spool of tubing to be loaded on the stand. Second, the spool has to be carefully aligned with the drive system on the stand. Spools wound with tubing are very large and heavy, weighing 30,000 to 60,000 lbs. on average. They are cumbersome and difficult to maneuver. Consequently, aligning a spool and the drive system on a rocking ship or in high winds is a difficult task. Third, as previously mentioned, standard and ordinary shipping spools are not built to handle the substantial loads encountered by a typical working spool.

Other types of reel assemblies require that the drive system be partially dismantled to allow removal of the spool. Additionally, if different size tubing is used, the level winding system also has to be partially dismantled to change sprockets and other drive components to provide proper spooling of the tubing. Changing the drive system and level winding system components are difficult and time consuming.

SUMMARY OF INVENTION

The invention overcomes difficulties found in the currently available systems by permitting more rapid replacement of spools on tubing reel assemblies. Transfer of coiled tubing from a spool used for shipping or transportation to a working reel assembly can be avoided.

In accordance with the invention, a coiled tubing spool is used as both a shipping spool and a working spool. The spool, once transported to a site, is "dropped" or lowered into a tubing reel assembly stand that is set up to rotate the spool. The stand includes two axles. The spool includes a support hub on each side. A slot defined in each support hub receives the ends of the axles as the spool is lowered into the stand. Each slot is then closed to capture the axle. As the spool is being lowered, a rotational coupling for turning the reel is simultaneously formed by a coupling member on the stand or spool sliding into engagement with a complementary coupling member of the other of the stand or spool. A power source on the stand rotates this coupling.

The invention has the advantages of allowing a spool wound with coiled tubing for a coiled tubing injector to be mounted to, and dismounted from, a stand, and coupled and uncoupled to a rotational power source, in a comparatively quick, convenient and reliable manner, with less manual activity and movement of mechanical coupling members. The stand need not be separated or disassembled, and the sides need not be moved laterally to accommodate the spool. Tubing spools can therefore be quickly changed as needed, with less potential for problems arising during changing. Additionally, a rotational coupling having one part mounted to a drive system located on a support stand and another part located on the tubing spool permits each spool to be fitted with the same type of coupling member, even if the spools have different diameters. The larger the coiled tubing diameter, the larger the spool's diameter must be. Stands can therefore be designed to handle a variety of different tubing spools, thus allowing strings of tubing to be moved from one location to the another without having to move the stand. Reel assembly stands can also be maintained, if desired, at multiple locations, and tubing of different sizes be shipped between locations on spools that can be used as working spools. The invention further permits, if desired, the stand to be made relatively compact, and not much wider than the width of the reel. The compact width of the stand allows for more tubing to be shipped legally across public roads that have width restrictions.

In a preferred embodiment of a coiled tubing spool and stand according to the invention, a coiled tubing spool includes a plate-like hub on at least one side. A slot is formed in the plate for receiving the end of an axle extending from the stand. A catch automatically closes the slot once the axle slides to the closed end of the slot. The catch may also be normally closed and automatically opened by insertion of the axle into the slot. A stand includes a drive plate corresponding to the plate on the spool. At least one of the two plates includes a tab located along its periphery that slides into another slot formed along the periphery of the other drive slot as the reel is lowered into the stand. With the tab and slot located some distance from the axle, on the edges of the plate, greater torque may be applied to the reel.

In accordance with a different aspect of the invention, a level wind system for a reel assembly includes a compact cartridge that can be easily removed and replaced to change the gearing ratio of its drive system. The drive system is coupled with a rotational power source on a coiled tubing reel assembly stand for turning a spool so that the level winding system and spool operate synchronously. The cartridge thus allows quick and accurate alteration of the level winding system's tracking speed to match the diameter of the loaded tubing.

One or more exemplary embodiments of a coiled tubing spool and stand combination for a coiled tubing injector system, in accordance with the invention as set forth in the claims, are described below in reference to the accompanying drawings. Additional advantages of various aspects of the exemplary embodiments will be identified in or are apparent from this description.

BRIEF DESCRIPTION OF DRAWINGS

FIGS. 19A and 19B illustrate schematically a first alternate embodiment of a catch for retaining a coiled tubing spool on an axle of a stand.

FIGS. 20A and 20 illustrate schematically a second alternate embodiment of such a catch.

FIGS. 21A and 21B illustrate schematically a third alternate embodiment of such a catch.

FIGS. 22A and 22B illustrate schematically a fourth alternate embodiment of such a catch.

DETAILED DESCRIPTION

In the following description, like reference numbers refer to like parts.

Figure 1A:
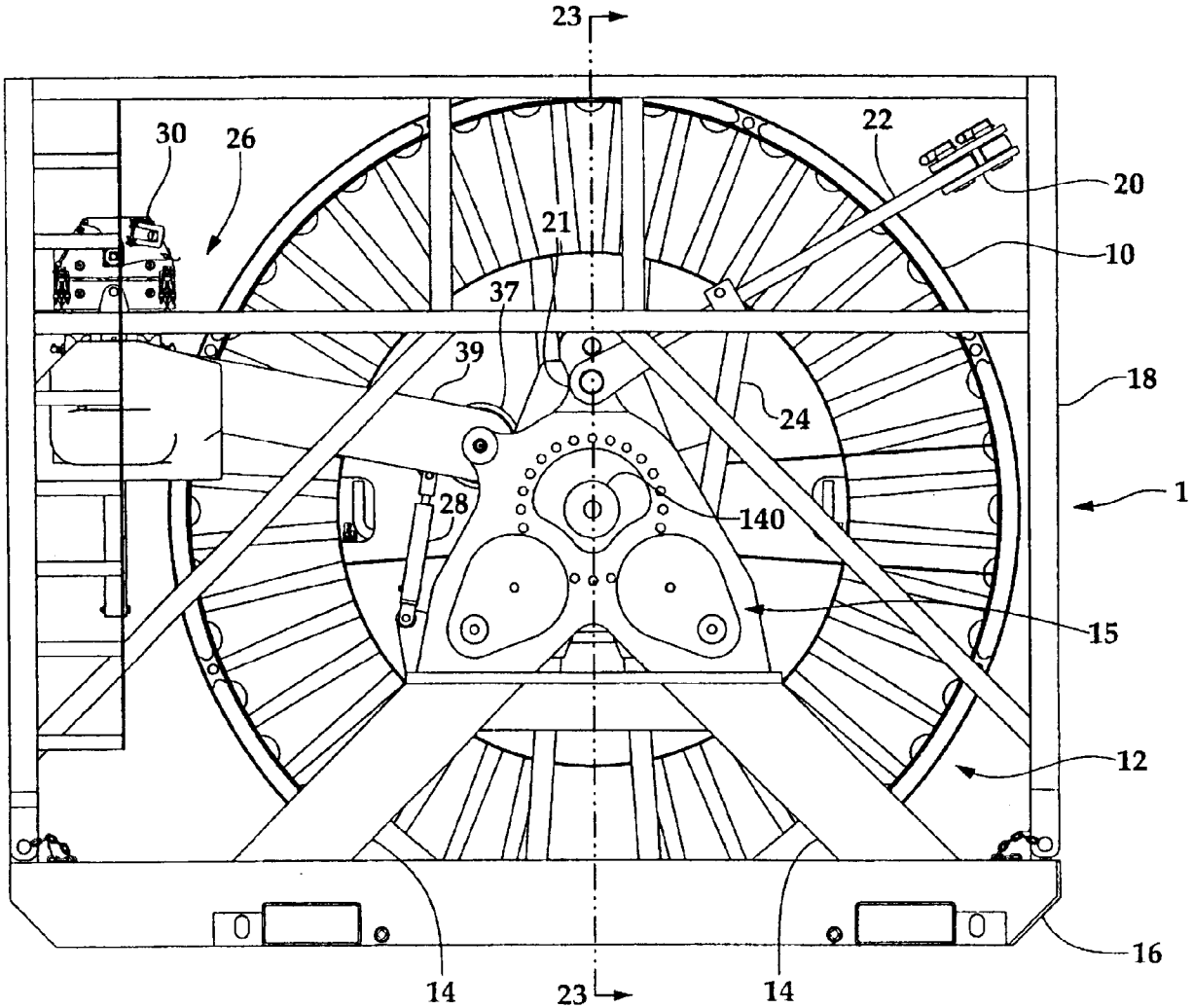
FIG. 1A is a side view of reel assembly, including a spool and stand combination, for a coiled tubing injector.
Figure 1B:
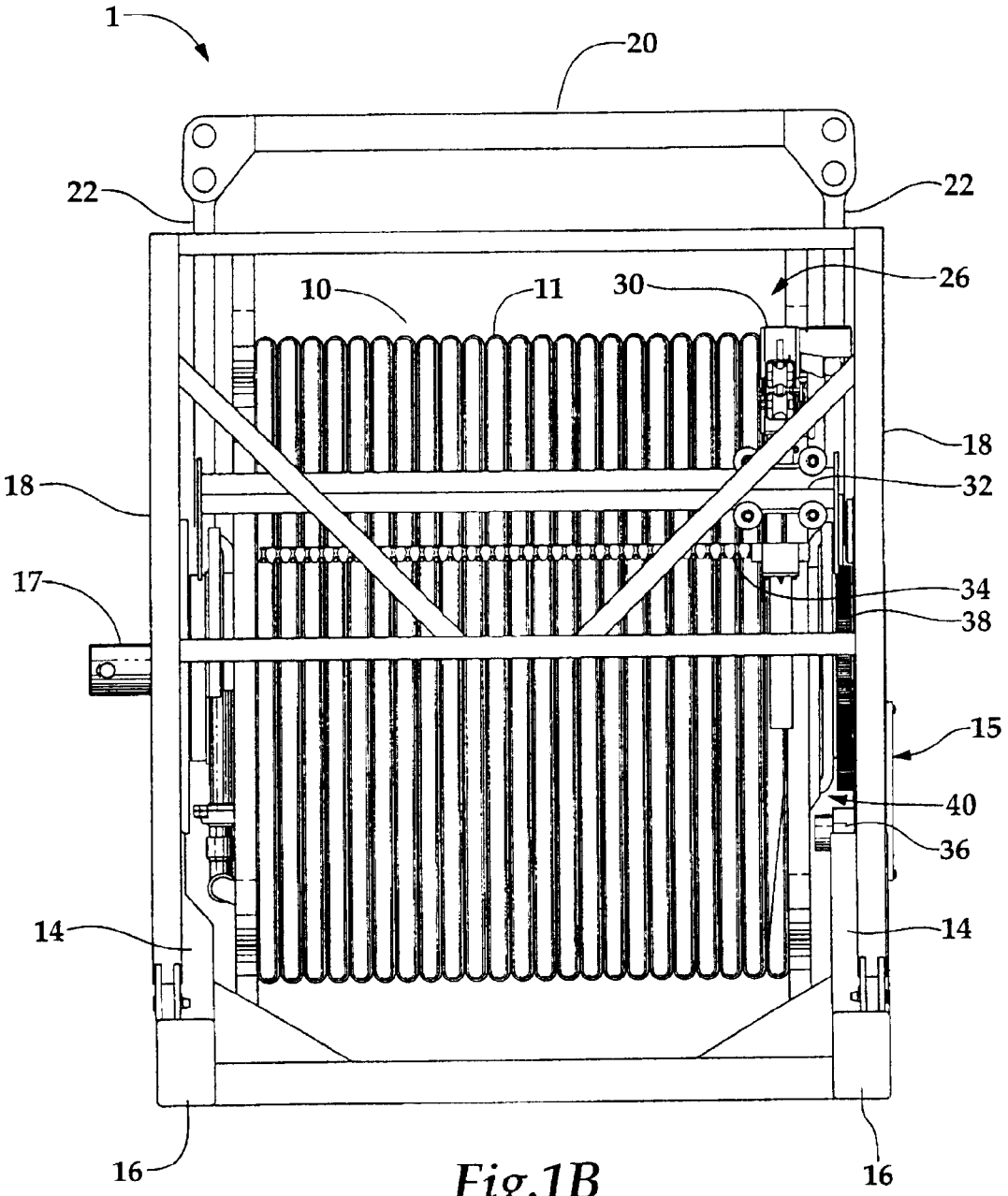
FIG. 1B is an end view of the reel assembly of FIG. 1A.

Referring to FIGS. 1A and 1B, tubing reel assembly 1 includes coiled tubing spool 10. Coiled tubing 11 is wound on the spool. The spool is operatively mounted on a stand, generally designated as 12. The stand includes legs 14 that support a drive unit 15 and an axle on which the spool rotates (not visible). The drive unit imparts rotational power to the spool. On the opposite side of the stand, a similar pair of legs 14 support another axle, on which the spool rotates, and a swivel connection 17 for connecting the coiled tubing 11 to a fluid source or drain. The stand is mounted on a pair of skids 16 so that it can be easily transported. A removable cage frame 18 protects the stand and spool, but is open at the top to allow the spool to be lowered onto the stand. A spreader bar 20 for hoisting the stand, and for raising and lowering the spool onto the stand, is shown attached to the top of the stand 12 at eyelets 21. The legs 22 of the spreader bar pivot to allow the bar to be moved out of the way during operation of reel assembly. Each leg is supported by an arm 24, which is attached to the leg by means of a sliding clamp.

A level winding mechanism 26 is also pivotally attached to the stand through a pair of support arms 39. A hydraulic cylinder 28 supports and pivots the arm of the level wind mechanism. Level wind mechanisms are well known. Coiled tubing is fed through a carriage 30 mounted on a track 32 for traversing across the spool as it rotates. As the carriage moves, it causes the coiled tubing to wind neatly on the reel. The carriage also supports the tubing as it unwinds. The carriage is powered by rotary screw 34 that is coupled to the drive unit 15 of the stand through timing gear 37. The timing gear 37 meshes with drive gear 38 to synchronize the level wind mechanism with the rotation of the spool. The timing gear turns a sprocket mounted on a common shaft. A drive chain (not visible, but see FIG. 25), which is mounted on the sprocket and extends within one of the two support arms 39, transmits power to the rotary screw 34. The drive unit is powered by two low profile hydraulic motors 36 (only one is visible in FIG. 1B). The motors 36 are tucked inside the stand to reduce the profile or overall width of the stand, taking advantage of the clearance between the spool and the stand necessary to accommodate a rigid rotary coupling for applying rotational power to the spool. One, two or more motors can be used, depending on requirements of the reel assembly. The motors deliver power to main gear 38 through reduction gear train housed within drive unit 15. The reduction gear train also has a relatively low profile as compared, for example, to planetary gears and other types of reduction gear arrangements. The drive gear is coupled to the spool through a rigid drive coupling generally designated by the reference number 40. More details of this coupling are described below.

Figure 2:
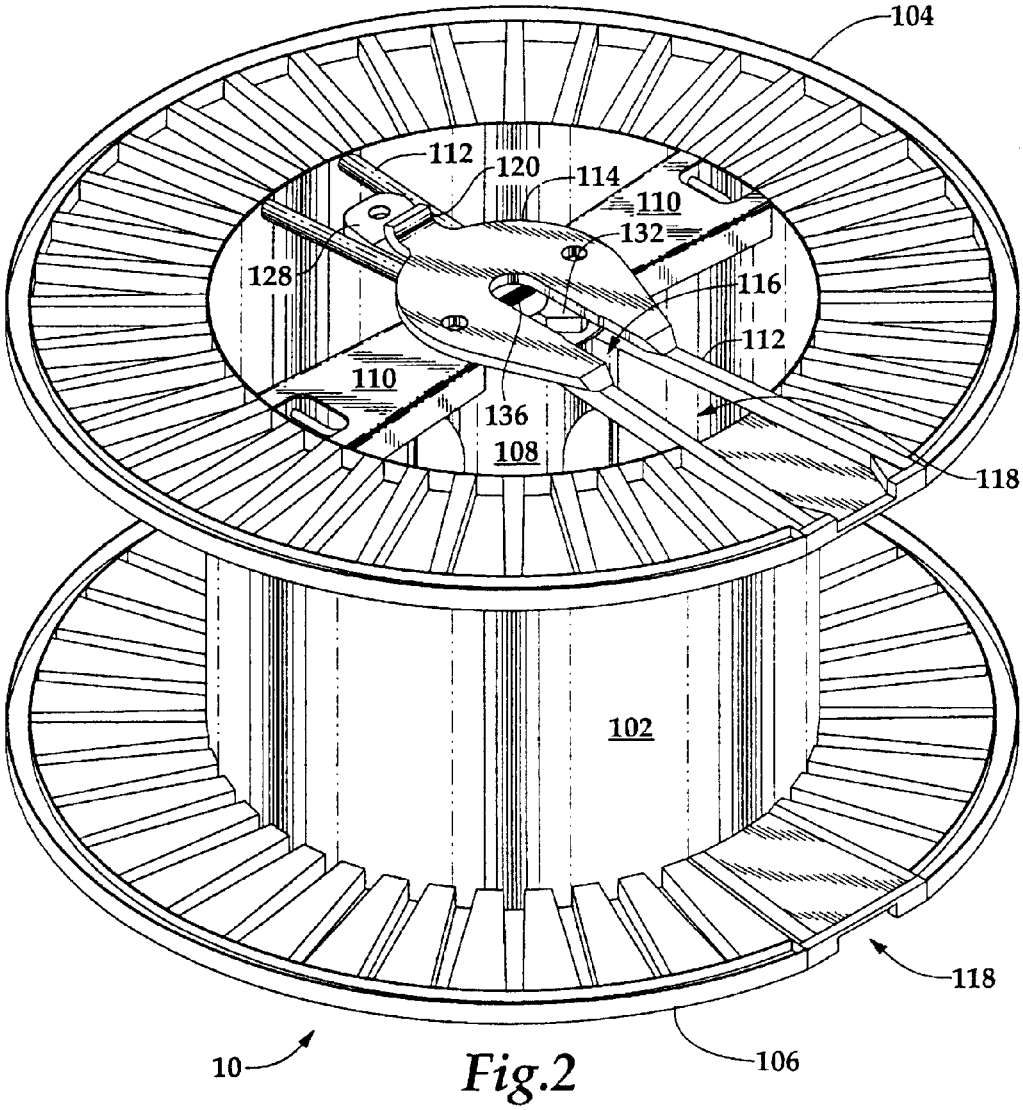
FIG. 2 is a perspective view of a spool for coiled tubing.
Figure 3A:
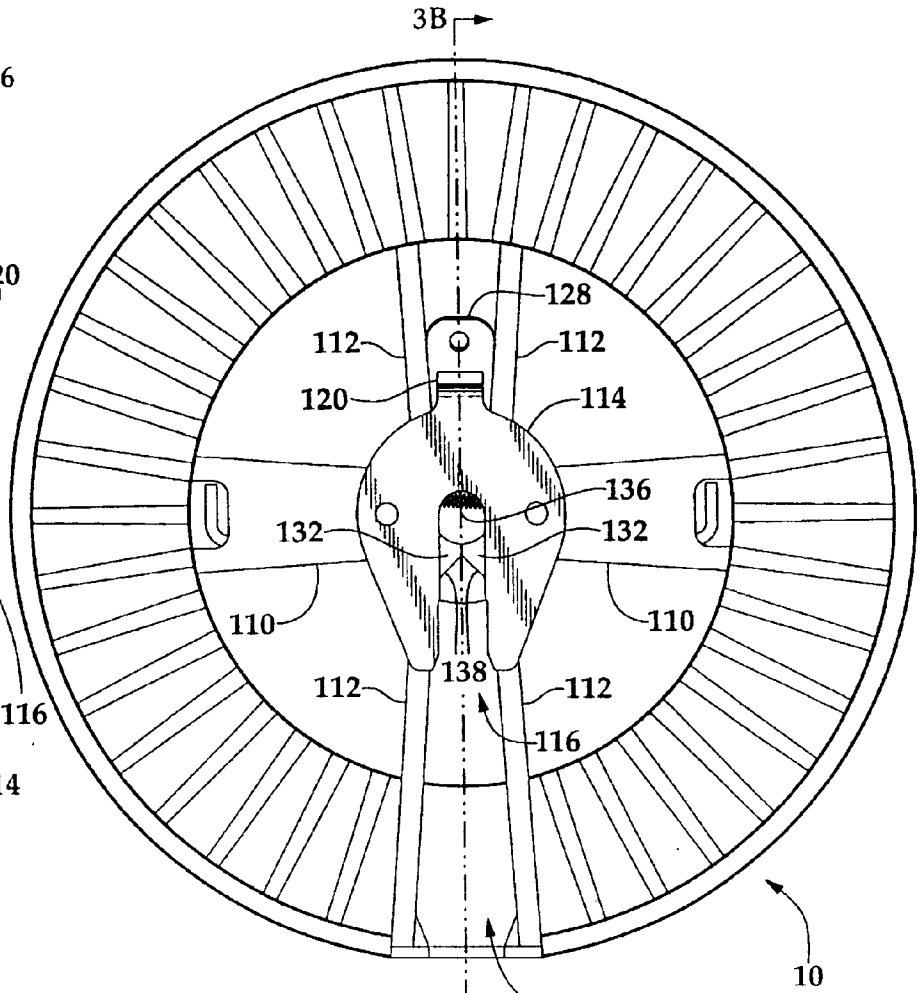
FIG. 3A is an end view of the spool of FIG. 2.
Figure 3B:
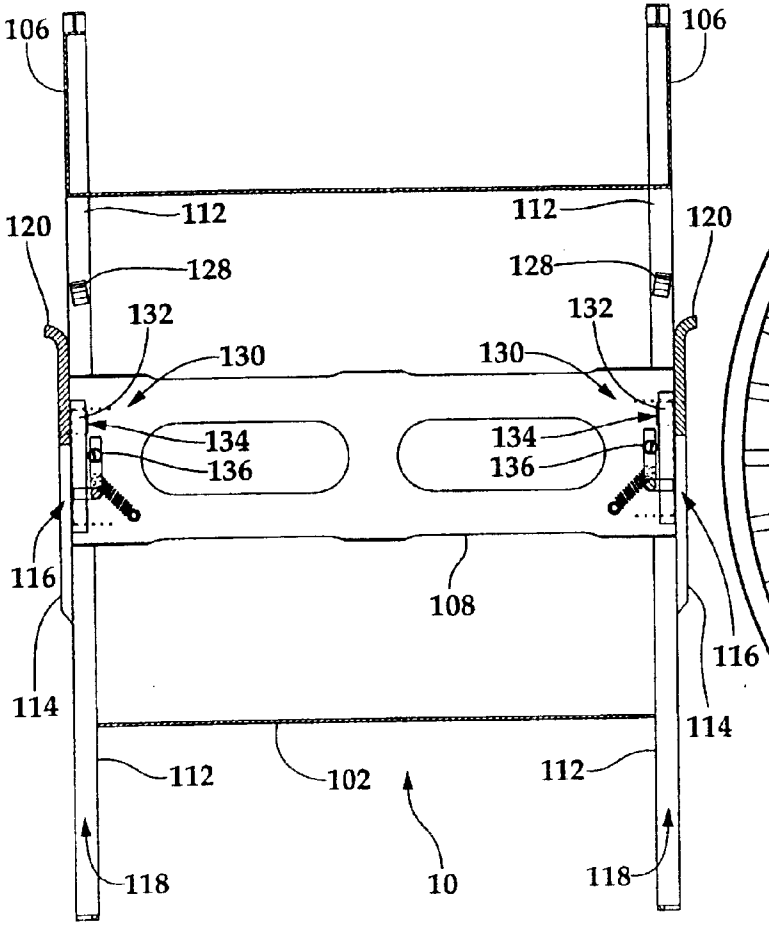
FIG. 3B is a side view of the spool of FIG. 2, sectioned along section line 3B–3B of FIG. 3A.
Figure 4:
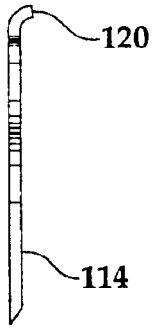
FIG. 4 is a side view of a drive plate of the spool of FIG. 2.
Figure 5:
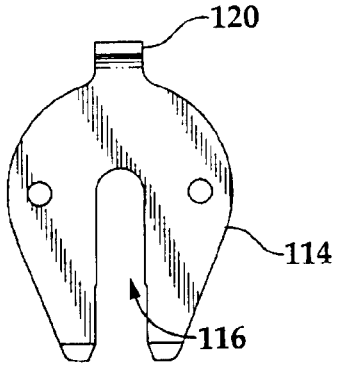
FIG. 5 is a front view of the drive plate of FIG. 4.
Figure 6:
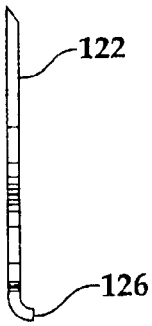
FIG. 6 is a side view of a drive plate on the stand shown in FIGS. 1A and 1B.
Figure 7:
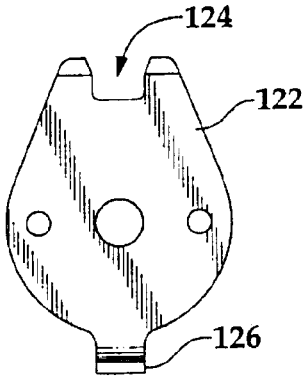
FIG. 7 is a front view of the drive plate of FIG. 6.
Figure 8:
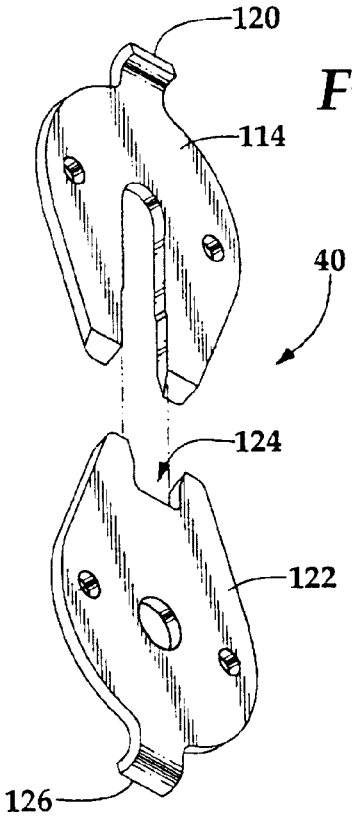
FIG. 8 shows a first position of the drive plates shown in FIGS. 4 and 6, prior to coupling, during lowering of the spool onto the stand of FIGS. 1A and 1B.
Figure 9:
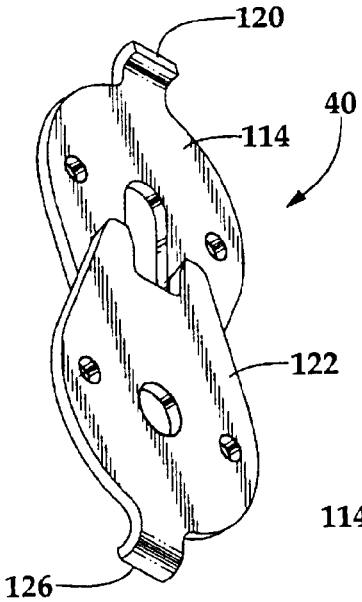
FIG. 9 shows a second position of the drive plates of FIG. 8 during coupling.
Figure 10:
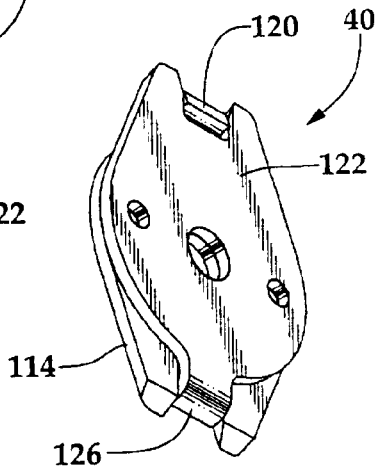
FIG. 10 shows a third, fully coupled, position of the drive plates of FIG. 9.

Referring to FIGS. 2, 3 and 4, spool 10 includes a drum 102, a right rim 104 and a left rim 106. The rims are attached at opposite ends of the drum. The drum is strengthened by a central support member 108 that extends along the axis of the spool and radial support members 110 and 112 at each end of the drum. A hub, centered on the central axis of the drum, is formed at each end of the drum on the sides of the spool—by a support member in the form of a plate 114. Each plate is mounted where the central support member 108 and radial support members 110 and 112 meet. The plate has defined in it an elongated slot 116. As will be described below, the spool will be supported for rotation on two axles extending inwardly from sides of stand 12 (FIG. 1). Each slot 116 will receive an end of an axle on a spool stand as the spool is lowered onto the stand. The slot guides the axle as the spool is being lowered. The closed end of the slot rests on top of the axle when the spool is fully lowered. The plate thus forms a collar-shaped member for supporting the spool on an axle. The slot will be closed once the spool is fully lowered onto the stand. Other types of support members generally in the shape of an open collar i.e. collar with a slot—could be used in place of the plate to provide support for mounting the spool on the axle. However, as described below, the plate can provide additional functions and benefits.

A pair of radial support members 112 define a channel 118 on each side of the spool that is aligned with the slot 116 on that side of the spool. The channel, which is defined in the side of the spool, provides additional clearance to receive the free end of each axle of the stand, and to accommodate, as will be described later, a catch mechanism for closing the open end of the slot. Use of the channel allows the spool and stand to have a narrower profile. However, the plate could be made to stand further away from the side of the spool, but only by sacrificing compactness through increased width. Each plate 114 also includes a tab 120 that will slide into a corresponding slot on a drive plate on the stand 12 (FIG. 1).

Referring briefly also to FIGS. 4–10, drive plate 122 is mounted on the stand and rotationally driven. Drive plate 122 includes an open-ended slot 124 that receives, as the spool is lowered onto the stand, tab 120 on plate 114. Similarly, drive plate 122 is also provided with a tab 126 that slides into the open end of slot 116 on plate 114. The engagement of a tab with a corresponding slot provides a rigid rotational coupling for transmitting torque to the spool. Each plate 114 will also be referred to as a drive plate for this reason. The two plates comprise the drive coupling 40 of FIG. 1B. A rigid coupling is important for controlling the spool and synchronizing the turning of the spool with the injector. If the rate of unwinding the coiled tubing does not match the rate at which the injector is operating, additional strain will be placed on the tubing. Each tab is axially displaced from the axis of the spool in order to increase leverage and thus provide better control. This particular coupling arrangement has the advantages that no movement of coupling members needs to be made after the spool is lowered, and it is self-aligning. Alternate couplings are possible and could be substituted, but possibly with the loss of certain advantages of the preferred embodiment. For example, an axle could have a key that fits in a spline formed at the closed of slot 116 in each plate 114, or vise versa. However, such an arrangement will tend to provide less leverage. Furthermore, substantial shearing forces on the key due to the large mass of the spool and the rotational forces applied to it will tend to cause deformation and failure. An axle also could be shaped to fit a socket formed at the end slot, for example, like a wrench that fits a bolt head. Again, such an arrangement provides less leverage and is subject to being deformed more easily by rotational forces applied to it. A pin or bolt could be inserted through drive plate 114, or other member, on the spool and a corresponding drive member on the stand to make the fixed coupling. However, this type of coupling requires manual assembly that would slow down changing a spool. A pin or other type of member that is spring-loaded to automatically extend when the spool is lowered requires additional clearance, resulting in a wider stand.

The spool includes two eyelets 128 for attaching vertical legs 22 from the spreader bar 20 (See FIGS. 1A and 1B) to lower and lift the spool.

Figure 13:
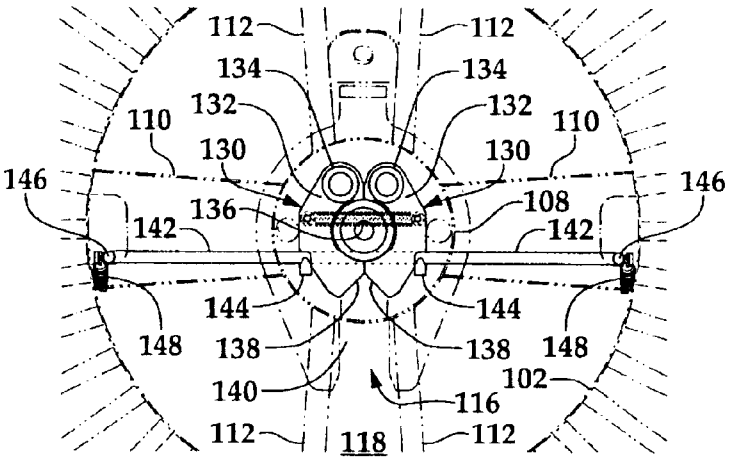
FIG. 13 is the same view as FIG. 11, except that the spool is fully descended and the catch has trapped the axle.
Figure 14:
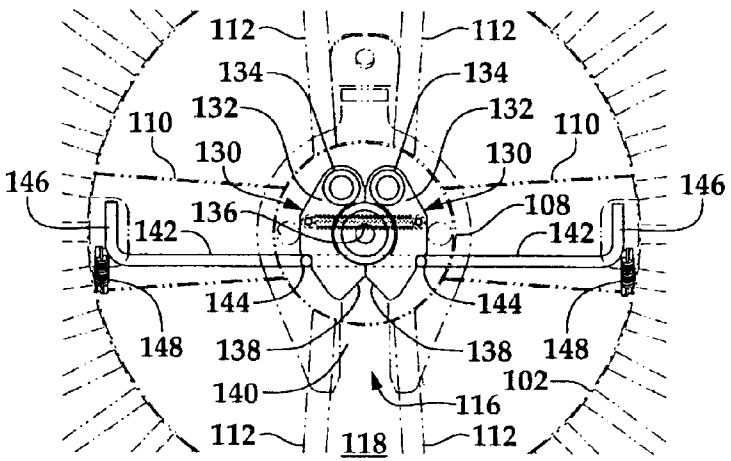
FIG. 14 is the same view as FIG. 13, except that a latch has been actuated to prevent the catch from inadvertently opening.
Figure 11:
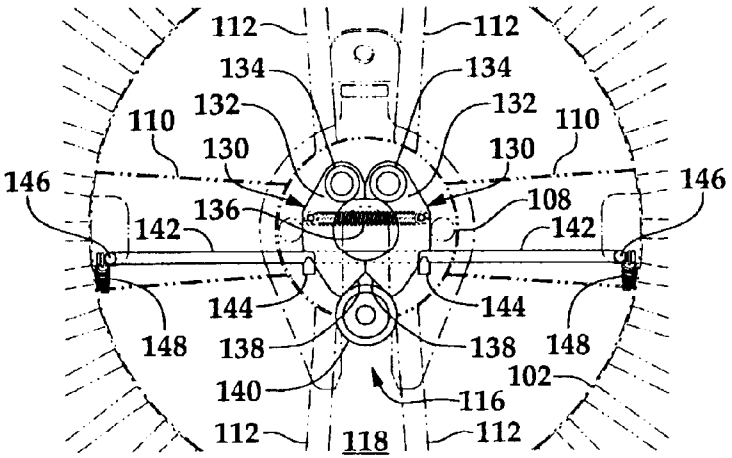
FIG. 11 is a side view of the reel assembly of FIGS. 1A and 1B during mounting of spool onto the stand, at a point prior to a catch within the reel engaging an axle on the stand. All features of the stand except for the axle have been removed for clarity of presentation.
Figure 12:
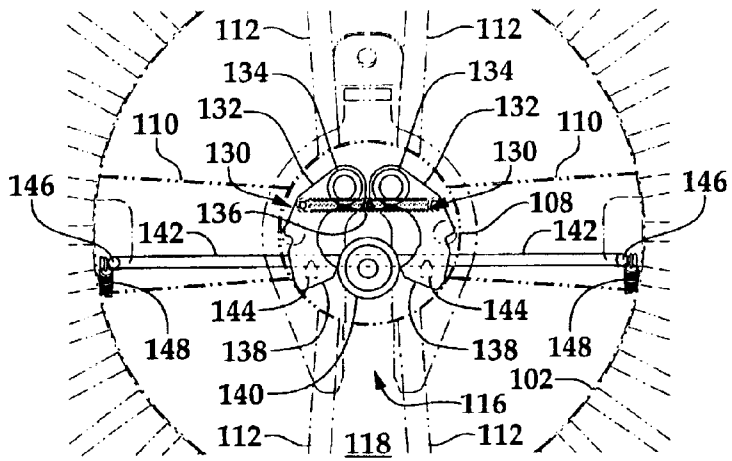
FIG. 12 is the same view as FIG. 11, except that the catch is open to pass the axle.

Once the spool is lowered onto the stand, the opening of the slot 116 must be closed to stop the spool from falling off the axles of the stand once it rotates. A catch is moved in a direction perpendicular to the axis of rotation of the axle to close the opening of the slot and trap the axle after the spool is lowered on to the axle. In the embodiment shown in FIGS. 2–3B, and FIGS. 11–14, catch 130 includes two arms 132 that are each attached to plate 114 on the spool by a pivot 134. The arms swing down and around the axle, in effect cradling it. The arms are pulled together by tension spring 136. Thus, the slot is normally closed. However, the free ends of the arms have oblique surfaces 138 so that axle 140 can spread apart the arms as it moves up the slot 116 during lowering of the spool. This action is illustrated by FIGS. 11 and 12. As shown in FIGS. 13 and 14, the arms then close under force of the stretched spring 136. Due to the shape of the arms immediately above the axle, the arms are also caused to pivot inwardly, around the axle, by the axle seating itself in the end of the slot 116. This particular embodiment of a catch therefore automatically opens and closes as the spool is lowered onto the axle.

Figure 16:
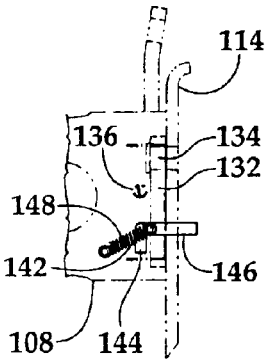
FIG. 16 is section of the spool of FIG. 15, taken along section line 16–16, mounted on an axle from the stand of FIGS. 1A and 1B.
Figure 15:
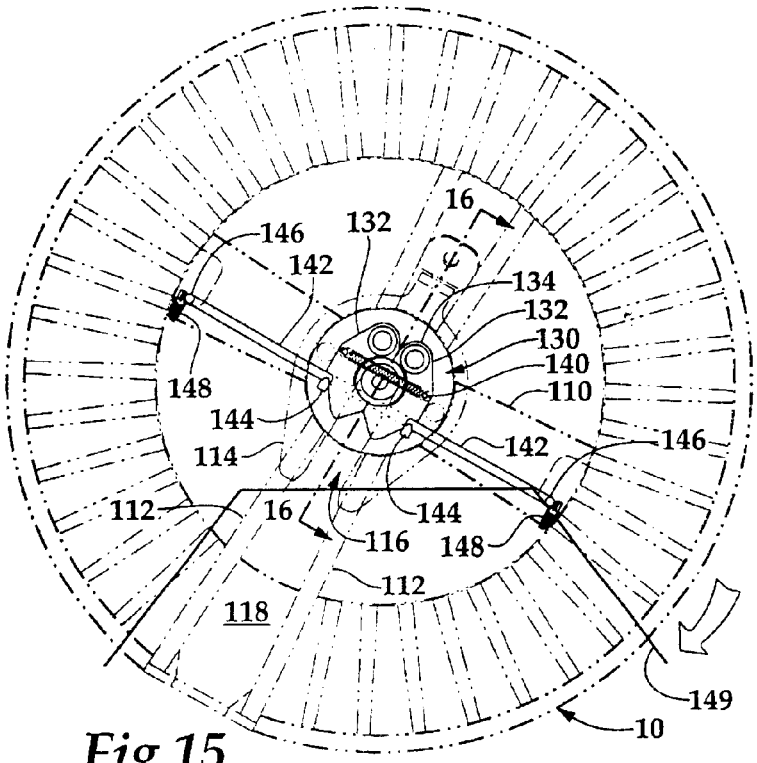
FIG. 15 is side view of the spool of FIGS. 1A, illustrated in phantom, to reveal details of the latch mechanism in an unlatched position.
Figure 18:
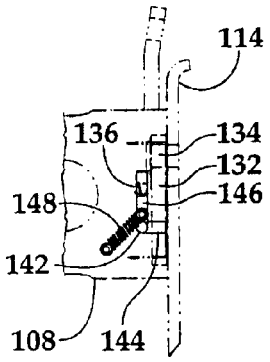
FIG. 18 is a section of the reel of FIG. 17, taken along section line 18–18.
Figure 17:
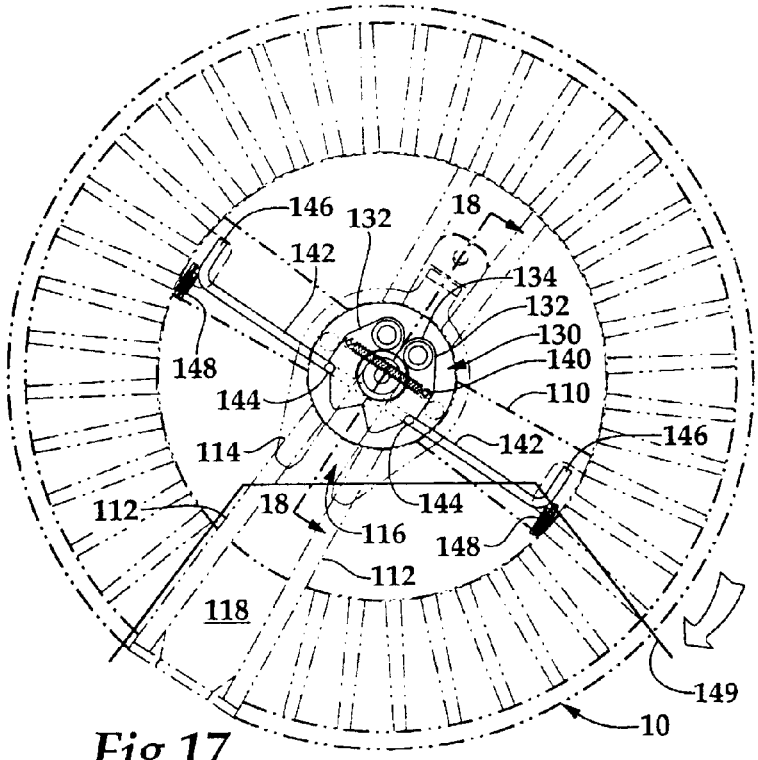
FIG. 17 is a side view of a spool like that of FIG. 15, except that the latch is in a latched position.

Referring now to FIGS. 2–3B, and 13–18, a latch is used to lock the arms 132 in place, after the spool is lowed onto the axles 140, to prevent the arms spreading under the weight of the spool when it turns to an inverted position (i.e. when the open end of slot 116 is facing up). The latch includes a bar 142 extending inside the radial support member 110. The bar includes two pins 144. The bar also includes at each end a handle 146 that can be accessed through openings in the radial support member 110. The handle twists the bar, causing the pins to rotate into the plane in which the arms 132 swing. When rotated, each pin engages a notch formed on the outside edge of each arm, thereby blocking the arms from moving outwardly. Springs 148 applies a force to bias the bar to either position to prevent the bar from inadvertently rotating. Referring specifically to FIGS. 15–18, the handle 146 sticks out beyond the side of the spool 10 when in the unlatched position, as shown in FIGS. 15 and 16. As the reel rotates in either direction from its position when it is lowered onto the stand, the handle will strike stand 12, which is represented by line 149, if it is in the unlatched position. Striking the stand causes the handle to rotate back into the reel to a latched position, thereby latching the catch, shown in FIGS. 17 and 18. This automatic latching ensures that the spool does not fall off the stand if latching the catch manually is inadvertently overlooked.

Referring now to FIGS. 19A and B to FIGS. 22A and B, several alternate embodiments of catches for closing slot 16 in plate 114 are illustrated. In the embodiment of FIGS. 19A and B, two ears 150, each pivotally attached at one end to plate 114, have oblique surfaces 152 that allow axle 140 to push back automatically the ears as the spool is being lowered. The ears are pushed together once the axle hits the end of the slot 116 to trap the axle. The ears can be, if desired, biased to a closed position by spring-loading rods 154, thus making the catch automatic in its operation during mounting of the spool. Pulling on the rods pulls apart the pivoting ears, thereby allowing removal of the spool. In the embodiment of FIGS. 20A and 20B, axle 140 is trapped by inserting manually a wedge 156 between the axle and asymmetrical blocks 158 formed attached to plate 114 on opposite sides of slot 116. In the embodiment of FIGS. 21A and 21B, the axle is trapped by a circular collar 162 that is manually rotated down and around the axle. Again, this catch must be manually moved. The catch shown in FIGS. 22A and 22b is an automated version of the catch shown in FIGS. 20A and 20B. It includes a trigger 164 pivotally connected to plate 114. The trigger, when in a cocked position, holds back sliding wedge 166. The wedge is biased by a spring attached to rod 168 to move toward the slot. When axle hits the trigger by moving to the end of the slot 116, the trigger pivots upwardly, releasing the wedge. The wedge then slides between the axle and the blocks 170.

Referring now to FIGS. 23–26, more details of the mounting of the spool to stand, the power unit 15 and its coupling to the spool, and the coupling of the coiled tubing wound on the spool through swivel connection 17, will be described.

Figure 23:
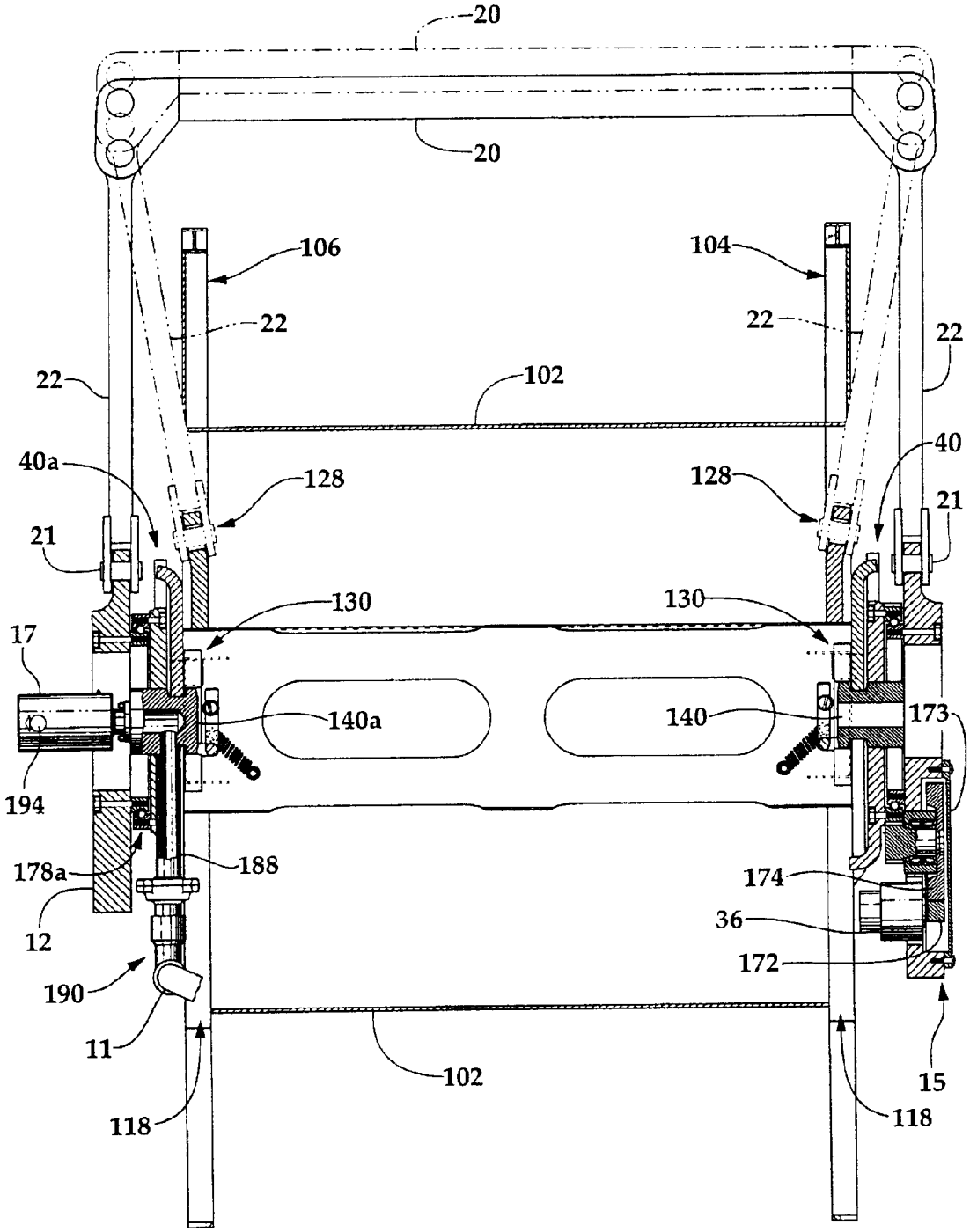
FIG. 23 is an end view of the coiled tubing reel assembly, including a spool and stand, shown in FIG. 1A, taken along section line 23—23, with portions of the stand and a protective cage removed.

Referring briefly only to FIG. 23, the spool is lowered onto the stand by the legs 22 of spreader bar 20. Spreader bar 20- can be used first to position the stand at the well site, as described in connection FIG. 1A, and then to lower and raise the spool by switching connection of the legs 22 to the eyelets 128 on the sides of the spool.

Figure 24:
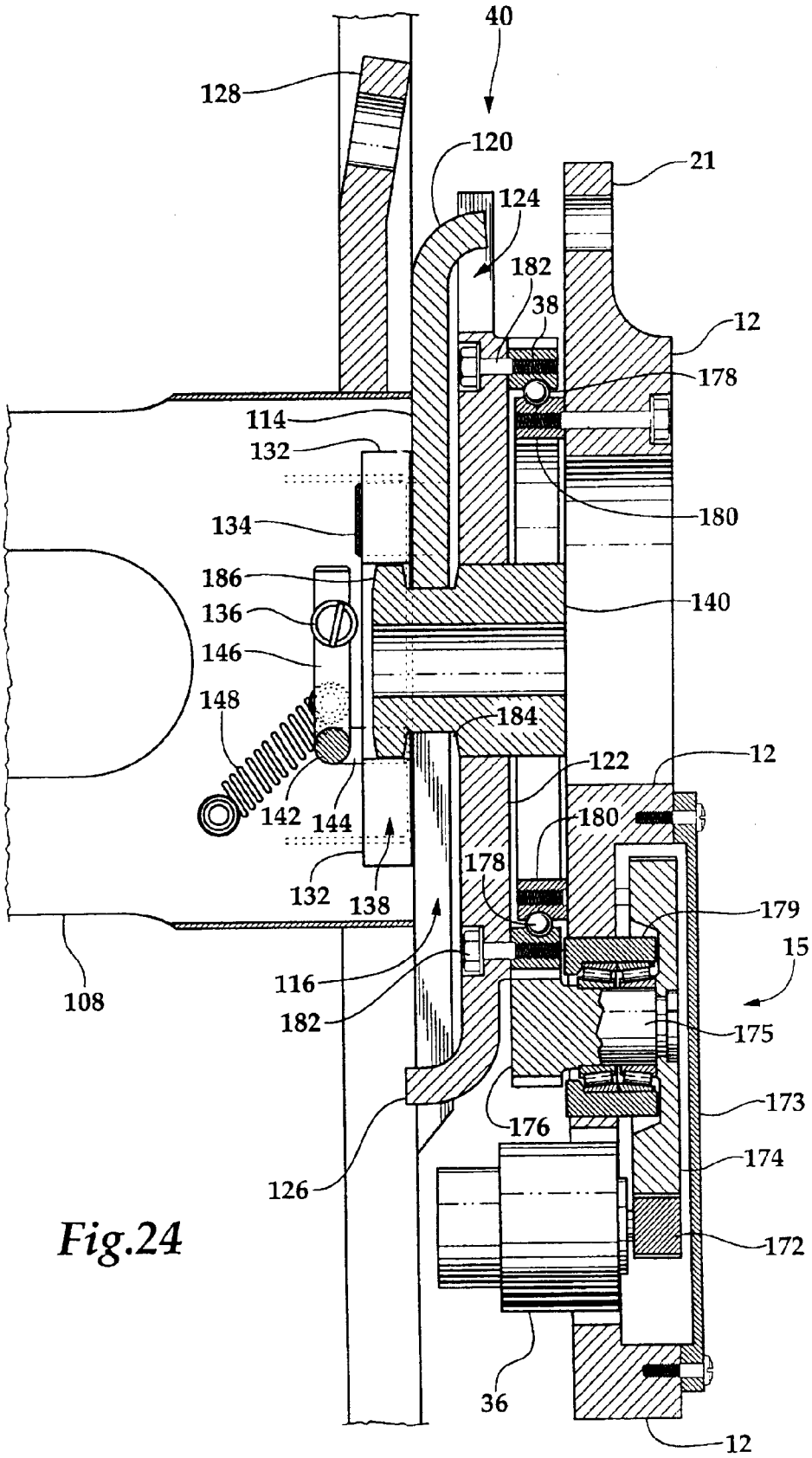
FIG. 24 is an expanded view of a portion of FIG. 23 showing the mounting of the spool onto the stand, and its coupling to a power source.
Figure 25:
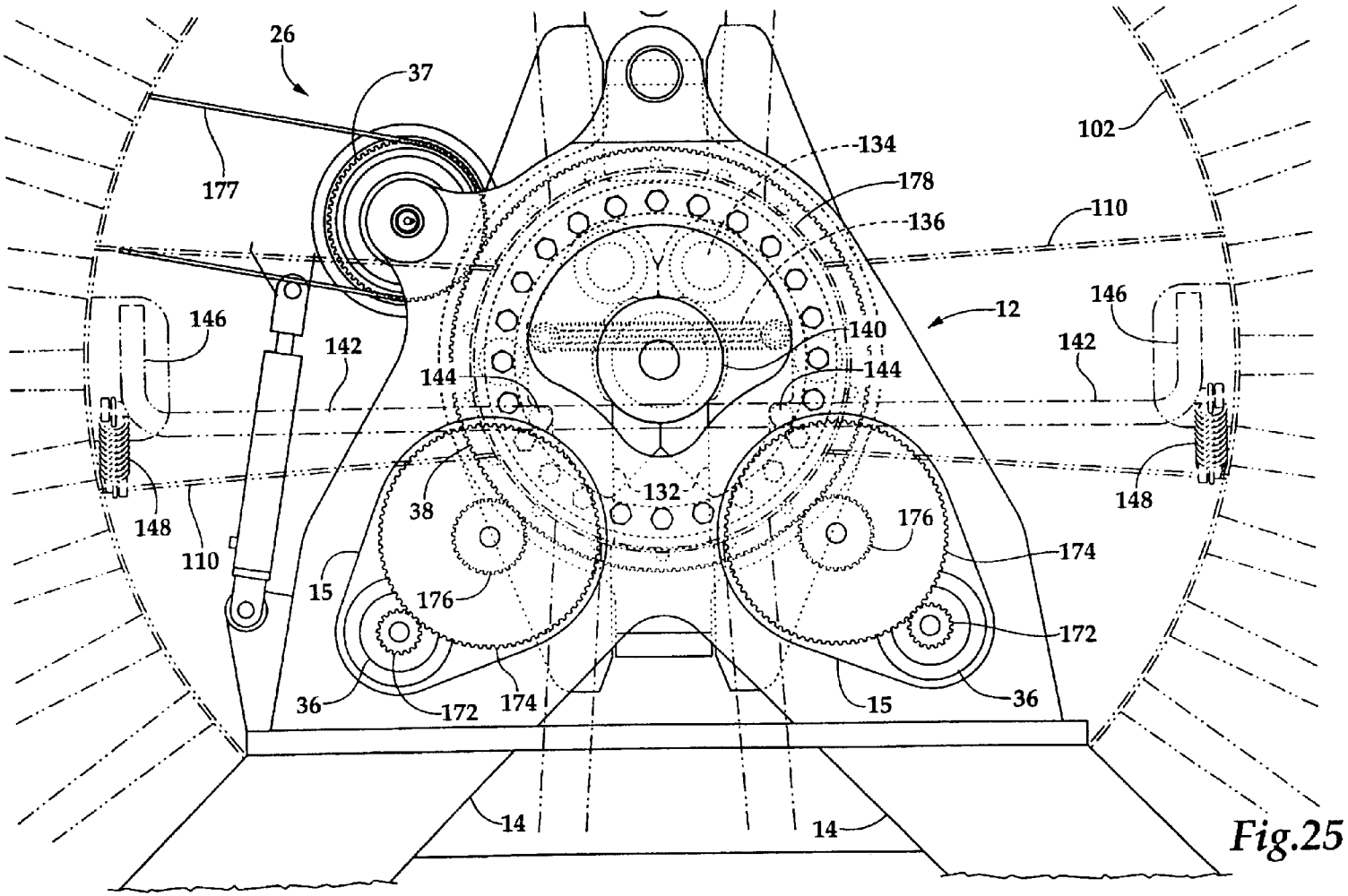
FIG. 25 is a side view of the stand shown in FIGS. 1A and 1B, with drive unit covers removed and certain otherwise hidden features of the drive unit shown for explaining delivery of rotational power from a motor to a drive gear and transmission for a level winding mechanism.

Referring now to FIGS. 23, 24 and 25, the output of each hydraulic motor 36 is connected to gear 172, which turns gear 174. Gear 174 has a larger diameter to reduce speed and increase torque. Each hydraulic motor contains an integral brake that prevents the spool from turning when not otherwise being turned by the motor. Braking force is applied by a spring. Application of hydraulic pressure to the motor releases the brake. Gears 172 and 174 are sealed within a cavity defined within stand 12 by cover 173. Gear 174 is mounted on output shaft 175 connected to output gear 176. The output shaft 175 is supported within the stand 12 by two races of roller bearings 179. Output gear 176 meshes with primary gear 38. Again, drive gear 38 has a much larger diameter, to give greater leverage and thus increase torque and reduce speed.

As previously mentioned, the motors are mounted on the inside of the stand 12 in order to take advantage of the clearance between the spool and the stand necessary to accommodate coupling 40. Although two motors and gear trains are used in the illustrated embodiment, only a single motor and gear train could be used. Furthermore, additional motors can be mounted to the stand in an arrayed fashion around the drive gear 38 should additional power be required. For example, as best seen in FIG. 25, the motors 36 are mounted at the "four o'clock" and "eight o'clock" positions around driver gear 38. Another motor and reduction gear drive train could be added at the one o'clock position by extending an arm on the stand at that position. This could be done without increasing the overall width of the stand. Furthermore, this arrangement allows timing gear 37 of the level wind mechanism 26 to receive power from the motors 36 and to be synchronously operated with the rotation of spool 10.

Referring only to FIG. 24, gear 38 takes the form, in the preferred embodiment, of a toothed outer race of ball bearing assembly 178. The inner race 180 is connected to the stand 12. Drive plate 122 is connected to driver gear 38 with bolts 182. Axle 140 is mounted through drive plate 122 and turns with the drive plate. Thus, there is no need for a bearing or journal between the spool 10 and the axle 140. However, an axle, as used herein, refers to a supporting member that carries a spool, and that either rotates with the spool to transmit power to it or allows the spool to rotate freely on it. It can take the form of a pin, shaft, bar, beam or spindle, for example. Thus, although axle 140, which in this illustrated form is most akin to a pin, rotates with the drive plate, it could be made stationary through a connection to the stand 12.

Axle 140 includes a groove 184, in which the sides of the drive plate 114 defining slot 116 (see also FIG. 3) slide. The groove in effect defines a head portion 186 of the axle that is captured by arms 132 of catch 130. Catch 132 transmits the load of the spool to the axle throughout the revolution of the spool on the axle. The axle is also hollow. The hollow axle allows wireline cable from the spool to pass through an opening in the axle, into its hollow core, and out to a slip-ring electrical connection assembly (not shown) that can be mounted to the axle or stand in a manner similar to the swivel connection 17 (see FIG. 26).

Figure 26:
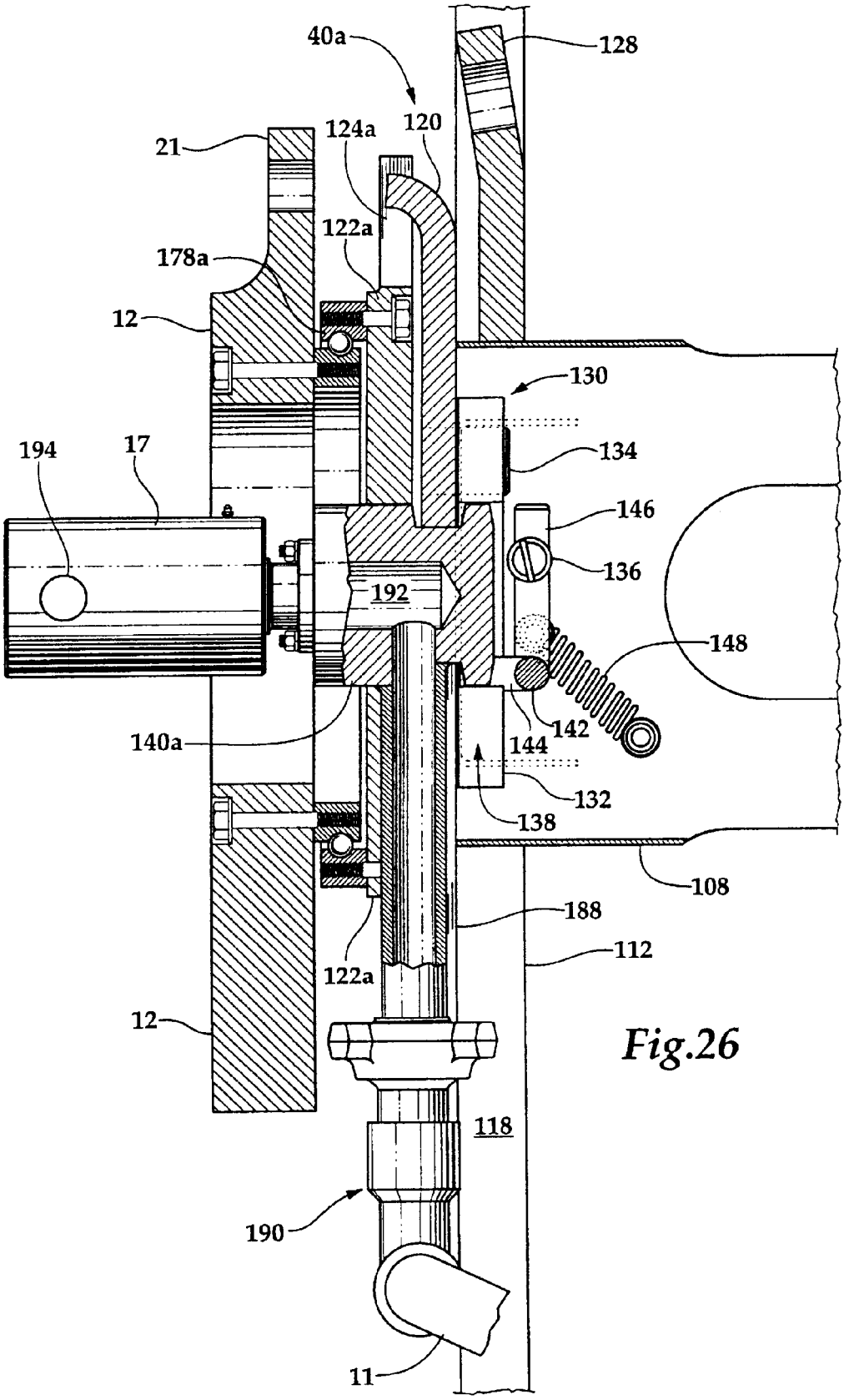
FIG. 26 is an expanded view of a portion of FIG. 23, opposite that shown in FIG. 24, showing the mounting of the spool onto the stand, and a fluid coupling between the reel and external plumbing.
Figures 27, 28:
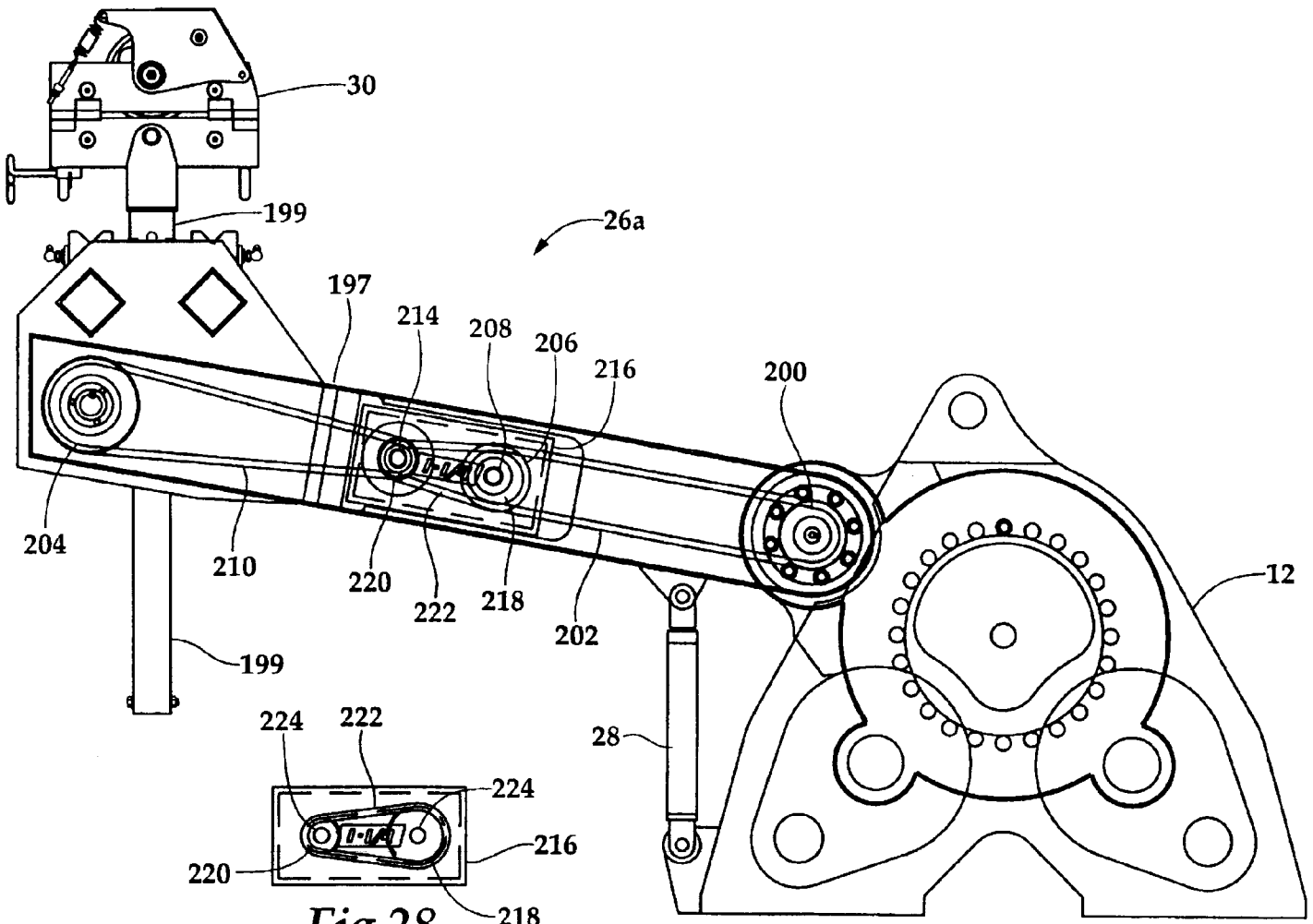
FIG. 27 is a side view of the stand for of the reel assembly of FIG. 1, except with an alternate level winding mechanism.
FIG. 28 is a side view of a gear cartridge for the level winding system shown in FIG. 27.
Figure 29:
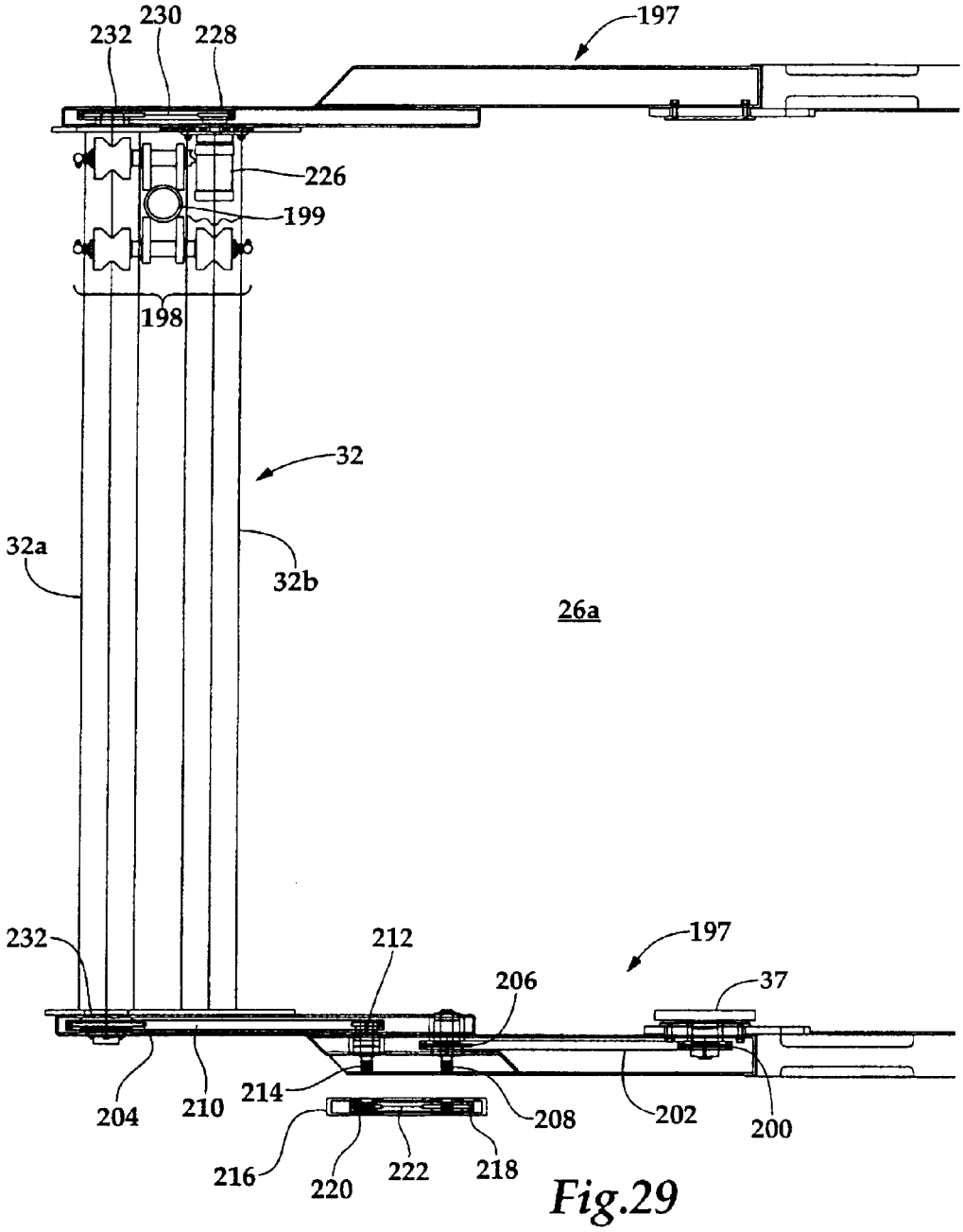
FIG. 29 is a top view of the level winding mechanism shown in FIG. 27, but with a tubing carriage removed.
Figure 30:
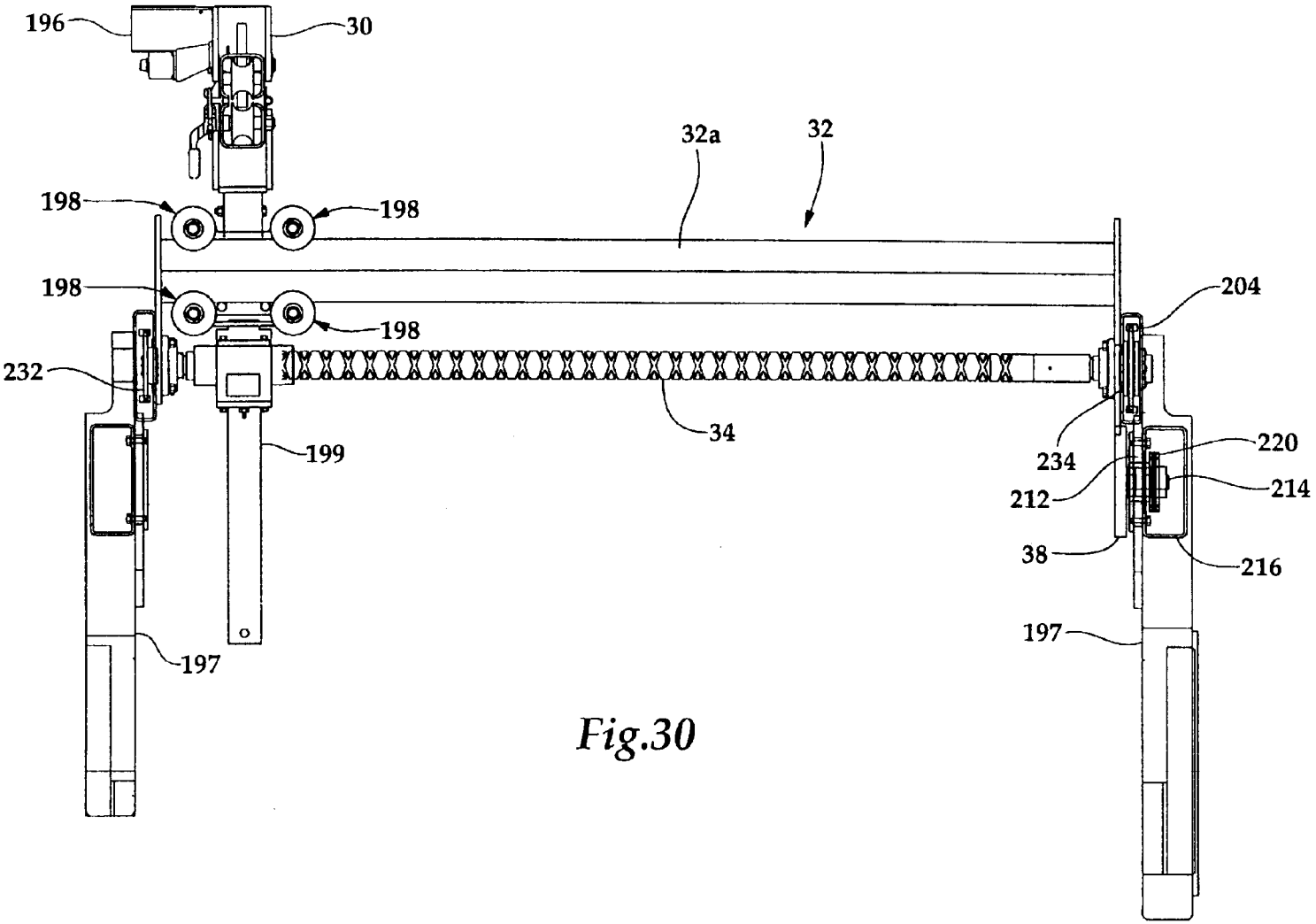
FIG. 30 is a side view of the level winding mechanism shown in FIG. 27.

Referring now only to FIGS. 23 and 26, because the coiled tubing will be carrying fluids to or from a well bore, a connection to the coiled tubing wound on the spool 10 must be made. The portion of stand 12 opposite of that depicted in FIG. 24 therefore includes a coupling for transmitting fluid to and from coiled tubing 11, which is wound on the spool, to an external plumbing system for handling fluids. The spool includes on this side the same mounting and coupling structure as on the other side so that the spool can be oriented in either of two directions. There is, for example, plate 114, with a slot 116 and channel 118, that allows axle 140a to slide into the hub of the spool. There is also catch 130 that closes the slot 116 and traps the axle, and a latch mechanism, which is formed by bar 142 and pins 144, for holding closed the catch.

The plate 114 of the spool couples with a corresponding drive plate 122*a* on the stand. Tab 120 on plate 114 falls into slot 124*a* on the drive plate 122*a*, thereby establishing a coupling 40*a* by which power for rotating the spool could be transmitted. Thus, drive plate 122*a* could be used for transmitting power, but is not in this particular example. The drive plate 122*a* is connected to an outer race of a ball bearing 178*a*. The inner race of ball bearing 178*a* is connected to stand 12. To deliver power to coupling 40*a*, ball bearings 178*a* can be replaced with ball bearing assembly 178, shown in FIG. 24, which includes an outer race with teeth that forms a drive gear 38. A drive unit to deliver power to the drive gear can then be installed. However, the motor for the drive unit would have to be installed either on the outside of the stand 12 or further away from the axis of rotation of the spool to allow clearance for coupling pipe 188 and its connection through coupling 190 to pipe 11.

Drive plate 122*a* is similar to drive plate 122. However, it includes a depression (not visible) for accommodating pipe 188, and does not include a tab 126, which would interfere with the pipe. Pipe 188 is connected to axle 140*a*. Both rotate with the drive plate 122*a*. Axle 140*a* is substantially similar to axle 140 (see FIG. 24), except that a bore 192 is defined in it. The pipe and the bore 192 carry fluid between swivel connection 17 and pipe 11. Coupling 190 is used to connect the end of the coiled tubing 11 to pipe 188.

During lowering of the spool onto the stand, channel 118 of the spool 10 and slot 116 of the plate 114 on the spool accommodate the pipe 188. The swivel connection is a conventional joint that allows each end of the joint to turn spool with respect to the other end. Thus, port 194 will remain stationary, allowing it to be connected to external plumbing for controlling the flow of fluids in and out of the well bore through the coiled tubing.

FIGS. 27–30 illustrate an alternate embodiment 26*a* for level winding mechanism 26 (see FIGS. 1A and 1B). Like the level winding mechanism shown in FIGS. 1A and 1B, it is pivotally attached to stand 12 through two support arms 197. Hydraulic cylinder 28 supports and pivots the arm of the level wind mechanism. As previously explained, coiled tubing is fed through carriage 30 as it is being spooled on and off of the spool. The carriage is of conventional construction, and includes a standard counter 196 that measures the length of tubing passing through the carriage. The carriage is mounted on linear track 32 so that it traverses across the spool as the spool rotates. The track includes two rails, 32*a* and 32*b*. The carriage rides on four pairs of rollers 198 to provide stability. Each roller pair is mounted on a common axle. The roller pairs are connected to pole 199, on top of which the carriage 30 is mounted. Two roller pairs ride on top of the two rails; and the other two roller pairs extend below the two rails. The carriage is moved on the track by rotary drive screw 34. The drive screw is double threaded so that the carriage will reverse direction when it reaches each end of the track. The level winding mechanism receives power for synchronous operation from the meshing of timing gear 37 with main gear 38, which cannot be seen in these views. The timing gear turns chain sprocket 200, which is mounted on the same shaft as the timing gear 37.

Unlike the level winding mechanism 26 shown in FIGS. 1A and 1B, level winding mechanism 26*a* includes a two part primary drive or transmission system for transferring power from drive gear 38 to the drive screw 34. The first part of the drive includes chain 202, which is mounted to sprocket 200. Chain 202 does not, as it would in the level wind mechanism of FIGS. 1A and 1B, extend to sprocket 204, which is coupled to drive screw 34. Rather, it is mounted to a sprocket 206, which turns a splined shaft 208. The second part of the drive is comprised of chain 210. The chain is mounted on sprockets 204 and 212. Sprocket 212 turns a second splined shaft 214. The splined shafts 208 and 214 are spaced apart at a fixed distance and have parallel axes of rotation.

In order to transmit power from the first part of the drive to the second part of the drive, timing gear cartridge 216 is plugged on the two splined shafts. Mounted for rotating within the timing gear cartridge are first and second sprockets 218 and 220, connected by a chain 222. Each sprocket is connected to, or has formed in its hub, a socket 224 for receiving one of the two splined shafts 208 or 214. Alternately, splined shafts could be connected to sprockets 218 and 220, and sockets connected to sprockets 206 and 212. The relative sizes of the sprockets 218 and 220 determine the drive ratio between the first and second parts of the transmission, and thus also the relative speed of drive gear 38 on stand 12 (see FIGS. 1A and 1B) to drive screw 34 on the level winding mechanism 26*a*. The use of the chain 222 mounted on two sprockets in timing gear cartridge 216, rather than two meshed gears, permits different gearing ratios to be accommodated without having to alter the distance between the splined shafts 212 and 214 (as well as the cartridge), or having to add more than two gears to the cartridge.

When a spool with tubing of a different diameter is installed on stand 12, the rate at which the level wind mechanism moves across the spool must be adjusted to take into account the different diameter of the tubing. If it is not changed, rotation of the spool on the stand and operation of the level wind mechanism will not be synchronized. A cartridge is made in advance of its need for each different diameter of pipe that might be used on the reel assembly. Cartridges can then be quickly and easily swapped to change the drive ratio of the transmission to the correct ratio. No complex mechanical adjustments are required to be made to the level wind mechanism for changing timing, saving time and ensuring correct operation when the stand 12 is used with spools carrying differing diameters of pipe. Although mounted on stand 12, where it has certain advantages, the level winding mechanism 26*a* could be adapted to other types of reel stands without loosing the advantages offered by cartridge feature.

The level winding mechanism includes a hydraulic motor 226 that is used to adjust the position of the carriage 30 without having to rotate a spool mounted on stand 12. The output shaft of the hydraulic motor turns sprocket 228, which rotates chain 230. Chain 230 rotates sprocket 232. Sprocket 232 is coupled to the drive screw 34. Sprocket 204, which receives power through the primary transmission from drive gear 38 on the stand, is coupled to the drive screw 34 through slip clutch 232. This slip coupling allows the carriage positioning motor 226 to turn the drive screw 34 independently.

Figure 31:
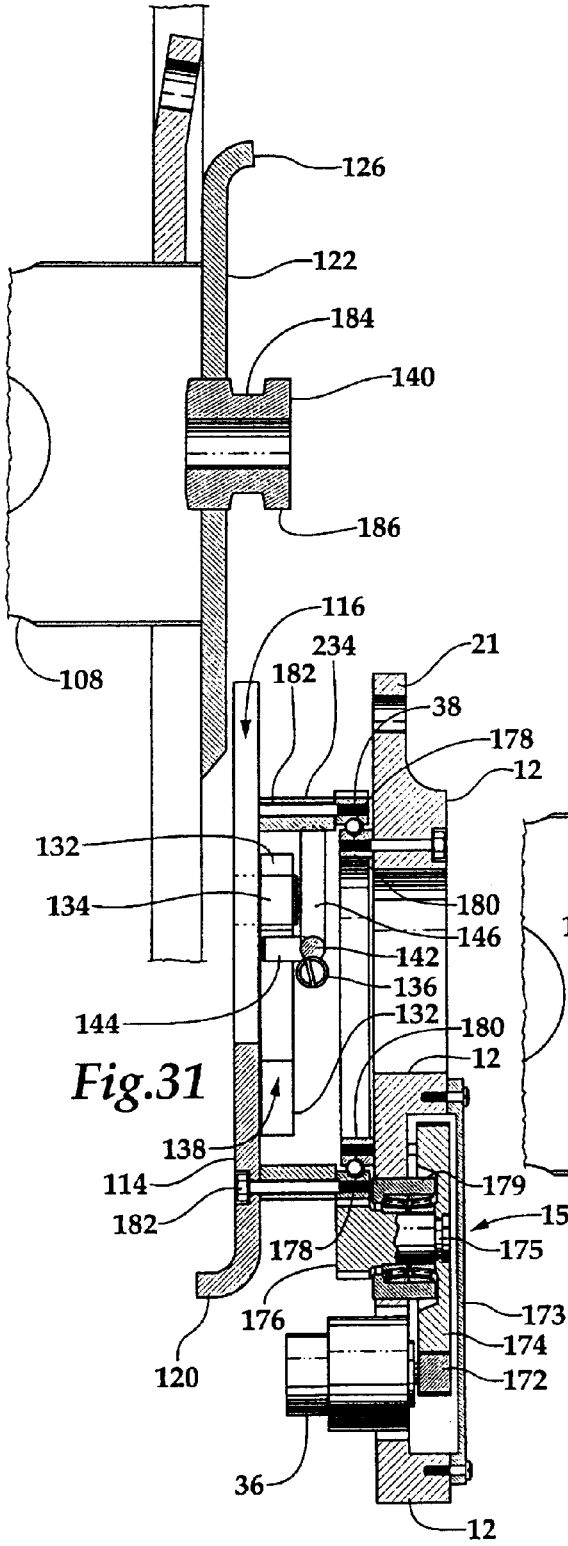
FIG. 31 is a cross-sectional view of one side the reel assembly having an alternate coupling arrangement for the spool and stand, the spool being lowered into the stand.
Figure 32:
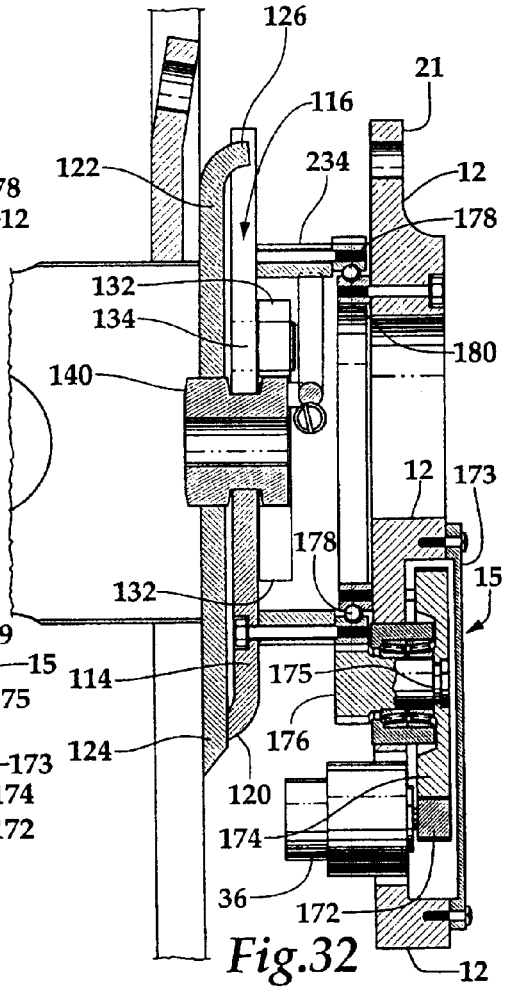
FIG. 32 is the same cross-section view of FIG. 31, but with the spool fully lowered into the stand.

FIGS. 31 and 32 illustrate that the positions of the male and female members of the coupling for rotationally mounting spool 10 on stand 12 may be reversed. Coupling of the axle 140 may be mounted to stand 12 instead of to the spool 10 as shown in FIGS. 1–26. In FIGS. 31 and 32, drive plates 114 and 122 have been switched: drive plate 114 is attached to the roller bearing assembly 178 of stand 12 and drive plate 122 has been attached to the hub of the spool 10. Drive plate 114 spaced apart from the stand by spacer 234 in order to accommodate a catch for closing slot 116 in plate 114. In the illustrated embodiment, the catch is substantially similar to the one shown in FIGS. 11–17.

Figure 34:
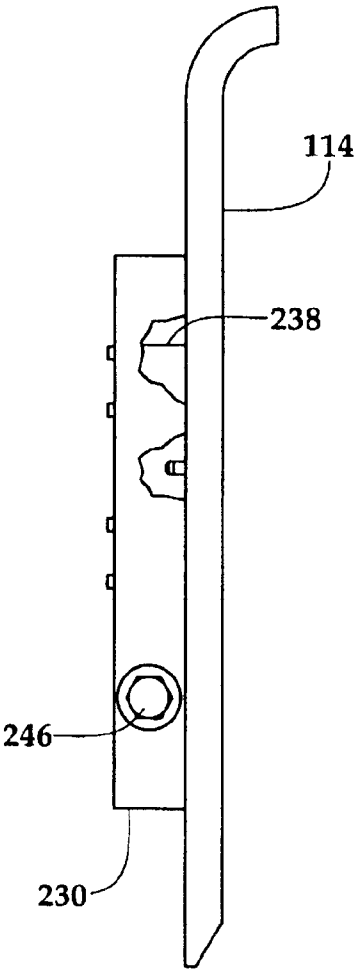
FIG. 34 is a side view of the alternate catch mechanism of FIG. 33.
Figure 33:
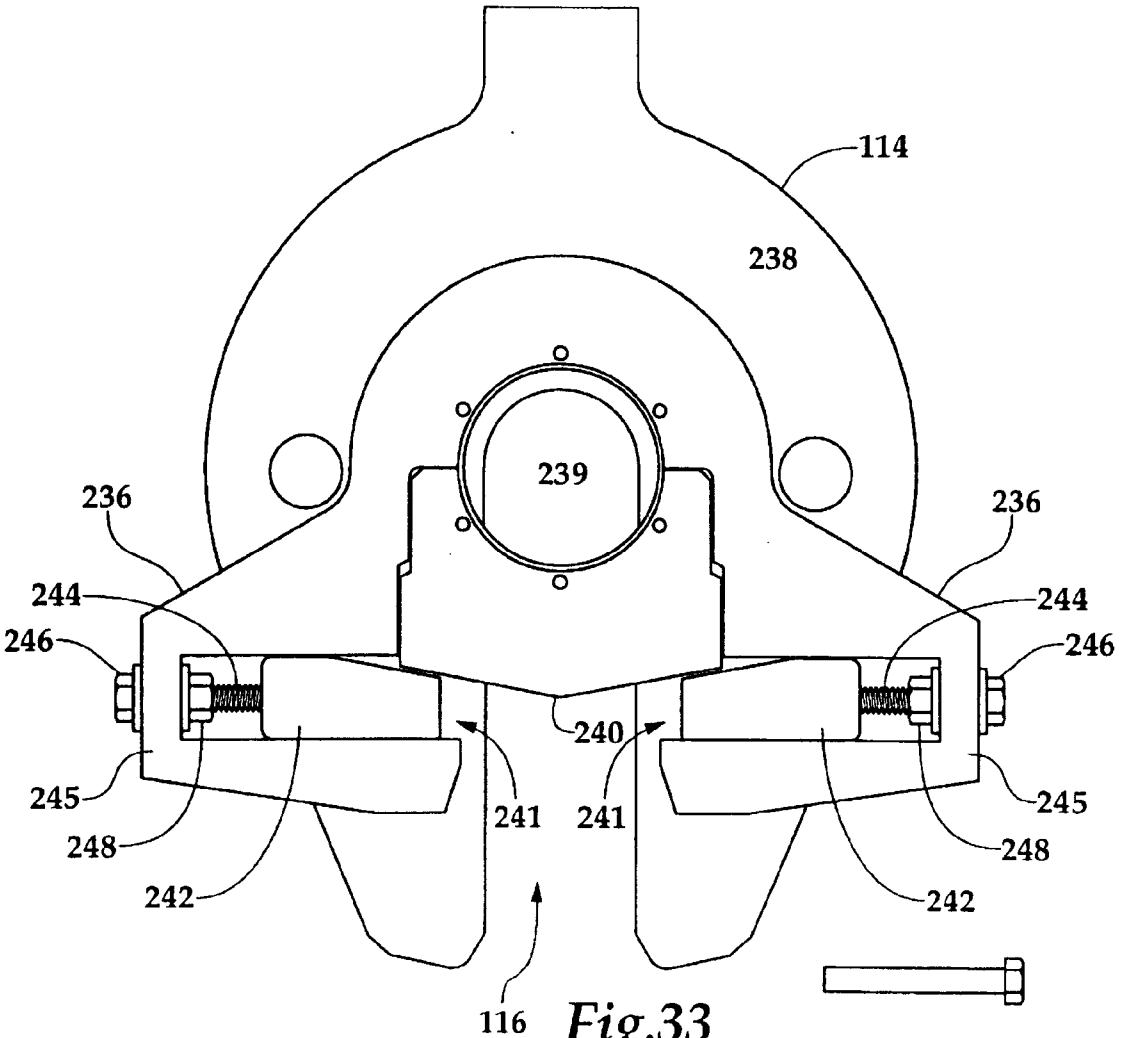
FIG. 33 is a front view of an alternate catch mechanism for the reel assembly.

Referring now to FIGS. 33 and 34, illustrated is an alternate form of a catch for closing slot 116 of drive plate 114. Drive plate 114 may be connected to either spool 10 or stand 12 (see FIGS. 1–26 and 31–32). The catch includes a catch body 236 having a semi-circular support collar 238 for receiving head 186 of axle 140 (not shown, but see FIGS. 31–32). Preferably, collar 238 is a bushing with a wear-resistant surface. Once axle 140 enters and seats within the support collar 238, a latch piece 240 is put into place to trap the axle (not shown). Although not shown, the latch piece includes portions that slide within channels in the catch body

236 to constrain the latch to movement within the plane of the body of the catch once it is installed after the axle moves through the slot 116. The latch piece includes a second, semi-circular bushing 239 for trapping the axle. Wedges 242 are moved inwardly within channels 241 to push the latch piece snuggly against lands formed on either side of the collar 238, thereby forming a closed bushing for supporting the axle. Rods 244 extending through clearance openings in end walls 245 that partly define channels 241 of the catch assembly. The rods are used to move the wedges inwardly and outwardly. The end of each of the rods is threaded and screws into a threaded bore formed in each of wedges. Nuts 246 and 248 are welded to each of the threaded rods, on opposite sides of wall 245, and hold them in place as they are being turned to move the wedges in and out. One advantage of this type of catch is that it very secure.

The forgoing description is made in reference to exemplary embodiments of the invention. However, an embodiment may be modified or altered without departing from the scope of the invention, which scope is defined and limited solely by the appended claims.

What is claimed is:

1. A coiled tubing reel assembly comprising:

a stand;

a spool having two sides between which is wound coiled tubing suitable for well bore operations;

each of the two sides of the spool including a first coupling member for engaging a second coupling member on the stand as the spool is lowered onto the stand, the first and second coupling members supporting the spool on the stand for rotation about an axis of rotation and operable for transferring rotational motion from the stand to the spool; and an element for locking the first and second members of the coupling together after the spool is lowered onto the stand.

2. A coiled tubing reel assembly comprising:

a stand;

a spool having two sides between which is wound coiled tubing suitable for well bore operations;

a mounting for each side of the two sides of the spool for supporting the spool on the stand for rotation about an axis of rotation, each mounting including a coupling of a support hub and an axle aligned with the axis of rotation; each support hub defining opening for receiving a free end of the axle as the spool is lowered onto the stand; and an element for closing the slot in the hub of one of the couplings, the element thereby trapping a corresponding one of the axles in the slot;

wherein the axle and the support hub of the coupling of the mounting for at least one of the two sides of the spool have complementary shapes for imparting torque from the one to the other.

3. A coiled tubing reel assembly comprising:

a stand;

a spool having two sides between which is wound coiled tubing suitable for well bore operations;

a coupling disposed on each of the two sides of the spool each coupling including a support hub and an axle aligned wit the axis of rotation; each support hub having defined therein a slot extending radially from the center of the hub outwardly in a direction normal to the axis of rotation, the slot having an open end for receiving a free end of the axle as the spool is lowered onto the stand; and an element for closing the slot in the support hub of the coupling on one of the two sides of the spool, the element thereby trapping a corresponding one of the axles in the slot;

wherein the support hub and axle of at least one of the two couplings possess complementary shapes for transmitting a rotational motion from the stand to the spool.

* * * * *

UNITED STATES PATENT AND TRADEMARK OFFICE

CERTIFICATE OF CORRECTION

PATENT NO. : 6,672,529 B2
DATED : January 6, 2004
INVENTOR(S) : Cain et al.

It is certified that error appears in the above-identified patent and that said Letters Patent is hereby corrected as shown below:

Column 8,
Line 52, please change “16” to -- 116 --.

Signed and Sealed this

Eighteenth Day of May, 2004

JON W. DUDAS
*Acting Director of the United States Patent and Trademark Office*